US005787815A

United States Patent [19]

Andersson et al.

[11] Patent Number: 5,787,815

[45] Date of Patent: Aug. 4, 1998

[54] STORAGE OF TRACK DATA IN A POSITION-CONTROLLED TILT SYSTEM

[75] Inventors: Evert Andersson; Per Fornander, both of Västerås; Per-Axel Roth, Nyhamnsläge, all of Sweden

[73] Assignee: Asea Brown Boveri AB, Vasteras, Sweden

[21] Appl. No.: 737,821

[22] PCT Filed: May 24, 1995

[86] PCT No.: PCT/SE95/00588

§ 371 Date: Nov. 20, 1996

§ 102(e) Date: Nov. 20, 1996

[87] PCT Pub. No.: WO95/32117

PCT Pub. Date: Nov. 30, 1995

[30] Foreign Application Priority Data

May 25, 1994 [SE] Sweden ..... 9401796

[51] Int. Cl.[6] ..... B61F 5/24

[52] U.S. Cl. ..... 105/199.2

[58] Field of Search ..... 105/171, 199.1, 105/199.2; 280/112.2

[56] References Cited

U.S. PATENT DOCUMENTS

| | | | |
|---|---|---|---|
| 3,717,104 | 2/1973 | Law et al. | 105/199.2 |
| 3,902,691 | 9/1975 | Ott | 105/171 |
| 5,295,443 | 3/1994 | Bangtsson et al. | 105/199.2 |
| 5,564,342 | 10/1996 | Casetta et al. | 105/199.2 |
| 5,636,576 | 6/1997 | Gimenez et al. | 105/199.2 |

FOREIGN PATENT DOCUMENTS

| | | |
|---|---|---|
| 271592 | 6/1988 | European Pat. Off. . |
| 0 561 705 | 3/1993 | European Pat. Off. . |
| 0 605 848 | 7/1994 | European Pat. Off. . |
| 39 35 740 | 5/1991 | Germany . |
| 8405046 | 4/1986 | Sweden . |
| WO 94/05536 | 3/1994 | WIPO . |

*Primary Examiner*—S. Joseph Morano
*Attorney, Agent, or Firm*—Law Offices Pollock, Vande Sande & Priddy

[57] ABSTRACT

A method and device for tilting a car body of a vehicle in a trackbound train when the train passes through a track curve. The respective vehicles in the train comprise bogies supporting a car body resting thereon, includes devices for tilting the car body in relation to the bogies, for indicating a track curve, and a control system for controlling the tilting of the car body in dependence on the geometry of the track curve. The position of the train along a route is determined point-by-point by the train being equipped with devices for detecting its position and by registering the curve geometry of the track when the train runs over a track section from the determined position, and storing it in real time as a sequence of measured values describing the curve geometry of the track section in an electronic memory. The curve-geometry data about the track section, previously stored in the memory is used for controlling the tilting of the car body during the next passage through curves within the track section.

13 Claims, 1 Drawing Sheet

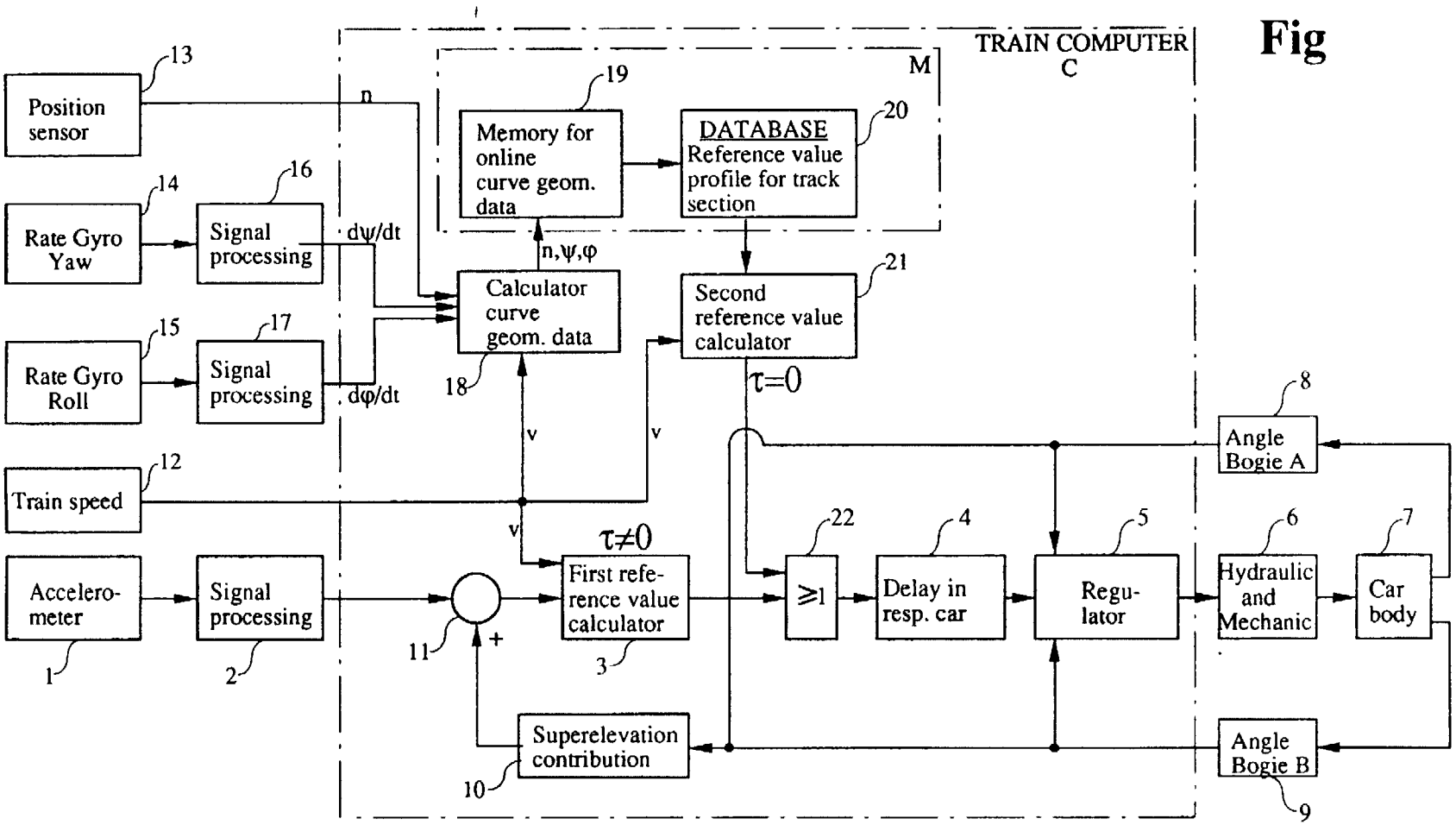
Fig

STORAGE OF TRACK DATA IN A POSITION-CONTROLLED TILT SYSTEM

TECHNICAL FIELD

The present invention relates to a method and a device for storage of curve-geometry track data for controlling the tilting of a car body of a railway vehicle when the vehicle passes through a track curve.

BACKGROUND OF THE INVENTION

It is known to increase the passenger comfort in a railway vehicle when the vehicle is running at a high speed through a track curve, by tilting the car body of the vehicle inwardly towards the curve while the vehicle is running through the track curve. In this way, the acceleration stresses on the passengers in the lateral direction are reduced, whereby the vehicle may be driven at a higher speed through the track curve while maintaining passenger comfort in the vehicle. To achieve tilting of the car bodies in the passenger vehicles which are part of a connected train set, these vehicles are provided with specially arranged car tilting systems. This car tilting system achieves tilting of the car bodies in relation to the bogies of the vehicles, i.e. the wheel undercarriages, rotatable at least in the horizontal plane, in which the wheels and axles are mounted.

The control of the car body tilting in the respective vehicle in a train set may be achieved in partially different ways. A common way is to generate a control signal for the car body's tilting as a reference value, the basis of which is the acceleration in the lateral direction, which is measured by an accelerometer in the front bogie of the train set (hereinafter referred to as the "lateral acceleration"). The lateral acceleration increases with the square of the speed of the train and proportionally to the curvature of the track curve (the inverse of the curve radius). The tilting of the car body may, for example, be controlled such that the tilting becomes substantially proportional to the measured lateral acceleration, thus compensating for the whole, the lateral acceleration because of the tilting of the car body. In case of full compensation, the so-called compensation factor is said to be equal to 1.0; without tilt compensation the compensation factor is equal to 0.

The measured acceleration signal can be received by a computer (train computer) in the vehicle at the front of the train. The computer calculates a reference value of the tilting of the car body and transmits the information (the reference value) on to the subsequent vehicles in the train in order for the car bodies of these vehicles to tilt in proper order when the train set passes through the track curve. The reference values for the tilting which are thus received by each vehicle are compared with the actual tilt angle (actual value) of each vehicle body. A difference value between the reference value and the actual value for the tilting is passed, via regulator to a drive system for execution of a tilting of the car body which corresponds to the reference value. The drive system may, for example, consist of a hydraulic system with pressurized working cylinders which bring about the forces required to tilt the car body in relation to the bogies supporting the same. Also pneumatic or electric drive systems may be used.

Because of irregularities in the track and the dynamic movements of the bogie, the measured acceleration signal fluctuates. Before the measured signal from the accelerometer can be utilized to form a reference value for the car body tilt, it must be filtered. Otherwise, the tilting movement would become very irregular and jerky. However when filtering, the signal, is delayed. Depending, among other things, on how large the irregularities of the track are, this filtering and hence the delay may be somewhat differently set for different operating cases. Certain additional delays may occur in both the computer and the drive system which executes the tilting movement.

The vehicle at the front of the train proceeds from a straight track into a transition curve, by which is meant a transitional part between the straight and curved part of the curve, wherein the curvature of the curve is successively and continuously changed. The first vehicle has time to run a certain distance into the transition curve before the delayed tilt signal is able to influence the tilting. The car body tilt of the front vehicle occurs somewhat too late in relation to the lateral acceleration caused by the speed of the train through the curve and which the tilting of the car body intends to completely, or at least partially compensate. The corresponding delay occurs also at the exit from the curve. A certain delay may in some cases also occur for the second vehicle in the train. The result of these delays may be that the passengers in the front vehicles do not experience the satisfactory comfort, despite the car body tilt. It may be experienced as disturbing for the passengers, especially if the passengers are standing or walking in the car. The problem is particularly noticeable when the leading vehicle of the train is used for passengers.

Track curves not only have curvature in the horizontal plane, but also normally a rail superelevation. This means that the outer rail of the track is elevated above the inner rail for the purpose of compensating for the whole, or part of, the lateral acceleration to which the train is subjected when negotiating curves, even with the tilting of the train in the lateral direction.

At the same time, the curvature of the curve, and hence the lateral acceleration, changes when running through a transition curve, and the rail superelevation in the curve also normally changes. The rail superelevation is thereby given the shape of a ramp, along which the vertical position of the outer rail in relation to the inner rail is continuously changed. At different positions in the longitudinal direction in such a rail superelevation ramp, the mutual vertical position between the rails becomes different. Differences in the mutual vertical position between the rails are called track cross-level. Since the rail superelevation is normally changed at the same time as the curvature of the curve and the lateral acceleration, the rail superelevation ramp and the track cross-level coincide, with respect to position and time, with the transition curve and with the increase of lateral acceleration.

Since the two bogies under a vehicle substantially on average incline to the same extent as the track does, under the respective bogie, differences in the lateral inclination of the bogies will be readable approximately at the same time as the lateral acceleration changes when entering and leaving curves. Differences in the lateral inclination of the bogies can be measured with substantially vertically directed position transducers between the car body and the bogie at each bogie side, provided that the car body is approximately a stiff body between the two bogies. The rail superelevation ramp can also be indicated with a gyro which measures the angular velocity for the rotation of a bogie around an axis in the direction of travel of the bogie. By adding a measured signal for track cross-level or rail superelevation to the reference value formed by the lateral acceleration, but delayed, the tilt movement may be accelerated and the comfort improved.

Still, however, a certain delay of the reference value remains, which results in deteriorated comfort as compared with what would be the case without reference value delay. This is true at least for the leading vehicle and, to some extent, possibly also for the second. Vehicles further back in the train set will drive through the curve much later that the reference value signal, despite the delay, normally arrives in time to be able to effect timely and correct control of the car body tilt.

To eliminate delay of the reference value which is otherwise unavoidable when running through a curve, at least in the leading vehicle, systems have been tested wherein the train partly senses the position along the track, and partly uses stored, pre-determined ideal data for the curve geometry in various curves along the track. In this way, correct tilting may be calculated in advance by a special calculating unit in the control system for the car body tilt. This calculation is made as a function of the position of the train, and its different vehicles, along the track. The disadvantage is that each train, which may be conceived to run on a certain track section, must have current updated data about the track geometry along the track section in question. The publications SE A, 8405046-7 (D1) and DE 3935740 (D2) describe examples of such technique in which a train is provided with exchangeable data sequences indicating the geometry of the track along a current track route. A method described in the above-mentioned publications entails an administratively heavy system, wherein a railway authority is forced constantly to provide trains with updated memory modules with data sequences containing new curve data for each change of the curve geometry along a route.

Another method presupposes the provision, in front of each curve, or each group of curves, of a stationary signal transducer containing curve-geometry data as a function of the position along the track after the signal transducer. The signal transducer is read by the train, during passage, and the information then obtained controls the car body tilt system of the train. The disadvantage of such a system is that it is necessary to arrange a large number of signal transducers (one transducer for each curve, or group of adjacent curves, in each direction of travel), and that the train may "miss" a transducer which may result in omission of the tilting of the car bodies of the train in a curve. Another disadvantage is that a signal transducer must be updated each time a line change is carried out.

SUMMARY OF THE INVENTION

One object of the present invention is to eliminate the delay in the reference value signal which forms the basis of, and is used in, the control system which controls the tilting of a car body in a vehicle included in a train when the train travels through a track curve. To achieve this in a car body associated with a vehicle in a trackbound train when the train passes through a track curve, where the respective vehicle in the train comprises bogies and a car body resting thereon, further means for tilting the car body in relation to these bogies, and means for indicating a track curve, and a control system for controlling the car body's tilt in dependence on the track curve geometry, the position of the train along the route is determined point-by-point by the train being equipped with means for detecting the above-mentioned position, by registering the curve geometry of the track when the train travels over a track section from the determined position, and storing it on-line as a sequence of measured values describing the curve geometry of the track section in an electronic memory, and by using curve-geometry data stored in the memory, about the track section derived from at least one journey which the train has made along the track section for controlling the car body tilt during passage of curves within the track section.

Data about the geometry of each curve track along a route are stored in the train computer in a database in the form of sampled values for the track curvature and the rail superelevation angle for each track curve. These data have been formed by measurement and have initially dynamic disturbances caused by the irregularities of the track. The disturbances are eliminated or reduced by filtering, whereby data are given a certain, approximately known, delay in relation to the actual track geometry. In connection with storage and updating, track-geometry data for the approximately known time delay are compensated. Stored data about the track curve, here called reference-value profile for the track curve (i.e. sampled values of the curvature and rail superelevation of the curve) are updated for each time the train passes through the same track curve.

By using stored data on the geometry of the track for the formation of a second reference-value signal which substantially without delay controls the tilting of the car body, the tilting also of the first car and the second car in the train can be initiated without delay when the train enters a track curve in dependence on the data about the geometry of the track curve. This is stored in the database in the train's computer from the preceding passage of the train or data from several preceding passages through the same track curve. This increases the passenger comfort in the first and subsequent cars of the train when travelling through track curves at a high speed, which is an object of the invention.

Another object of the invention is to eliminate the need of storing ideal data, known in advance, about the track geometry for each track section, since track-geometry data for a route according to the invention are continuously registered and stored, and changes in the track geometry are noted by the train computer in use for subsequent travel by the train over the route. This eliminates a train's need for constant access to data sequences with track-geometry data in some form of replaceable memory modules which have been provided with the latest track-geometry data about a route, for example according to the method described in publications D1 and D2.

Further, the train may be provided with transducers for forming a first reference-value signal for control of the tilting of a car body in a traditional and known way in the form of an accelerometer for sensing the lateral acceleration and transducers (gyros or position transducers sensing the track cross-level) for detecting the rail superelevation ramp of the curve. This first type of reference-value formation is chosen if there are no stored track-geometry data in the database of the train (e.g. the first time a train runs along a certain route). It may also be chosen by the train personnel, during all of or parts of the route, for example, if it is known that the track geometry has undergone major changes since last time the train run over and stored track-geometry data about all of or parts of the route in question.

The train is equipped with a position sensor, whereby the position of the train point-by-point may be determined by reading position transducers located along the route. The position transducer transmits to the train computer information about the track section into which the train enters. The current position of the train within the track section is then calculated as a function of the train speed from the read position on the line.

Position transducers along the route may comprise special signal transducers, or be integrated with existing signal transducers, so-called transponders, along the track. The position indications may include information about the route on which the train is running as well as information as to where, along the line, the train is located. Alternatively, the train driver may indicate the route manually.

Another way of determining the position of the train along a route is given by the possibility of utilizing satellite navigation, Global Positioning System (GPS). By connecting a GPS receiver to the train's computer, the position of the train may be read continuously. In this way, a track section along the track may be identified, for example, by the position for the starting-point of the track section stored in the train computer, whereby the reference-value profile for the corresponding track section may be read from the computer memory, and be written into the computer's memory, respectively, when the GPS receiver detects a train position which coincides with the starting-point of the track section.

The first time a train passes over a certain route, the current curve geometry is measured, processed, and stored in memory of a train computer which is part of the control system of the train. At the same time, the information about the curve geometry in real time is used immediately for controlling the tilting system in the manner described earlier, resulting in the disadvantage that a delay for tilting of at least the first cars in the train occurs.

The geometry of a curve is determined by measuring two variables, namely, the course of the curvature of the curve, and the course of the rail superelevation.

The curvature ($\rho(s)=1/R(s)$) of the curve, i.e., the inverse of the curve radius R(s), as a function of the longitudinal position (s) from the starting-point (s=0) of a track section or the starting-point (s=0) of a curve is determined by measuring the angular velocity ($d\psi/dt$) around a vertical axis and dividing this angular velocity by the instantaneous overall travel speed (v)

$$\rho = 1/R = \frac{d\psi}{dt} \cdot \frac{1}{v} \tag{1}$$

The rail superelevation angle ($\phi(s)$) of the curve as a function of the longitudinal position (s) is determined by the time integral of the angular velocity ($d\phi/dt$), measured around a longitudinal axis. That is, $$\phi(s) = \int_0^t \frac{d\phi}{dt}\, dt = \int_0^s \frac{d\phi}{dt} \cdot \frac{1}{v}\, ds \tag{2}$$

The two angular velocities may be measured by gyros, suitably located in the first bogie of the train. The disturbances effecting the signals must be filtered off, which provides signals with approximately known delays.

Sampled values of the curvature $\rho$ and the rail superelevation angle $\phi$ are stored online in the database of the train computer as an updated reference-value profile for each track section of the covered route with the given starting position of the track section as the starting-point, whereby the reference-value profile will contain the latest curve-geometry data of each track section. Before being stored, sampled values are compensated for the approximately known time delay which is obtained during the filtering.

The car body tilt may, for example, be controlled to be proportional to the lateral acceleration ($a_y$). The lateral acceleration is determined approximately by the following expressions, where g is the gravitational acceleration $$a_y \approx \frac{v^2}{R} - g \cdot \sin\phi = \rho\, v^2 - g \cdot \sin\phi \quad (m/s^2) \tag{3}$$

The second, and subsequent times that the train runs over a certain route, the previously measured and stored curve geometry for curves within a certain track section is used to calculate, and in advance, in a special calculating unit, correct reference values for tilting of the car body for curves within the track section. This calculation is made as a function of the position of the train, and of its various cars, along the track within the track section.

Since the delay in the stored signals is approximately known, this can be taken into consideration in the calculation, and the tilting of the car body of the respective vehicle may take place at the correct time for all vehicles of the train.

The system receives a self-correcting function for changes in curve-geometry data, as from the running which takes place immediately after the changed track-geometry data were measured and stored. To reduce the dependence on accidental occurrences during an individual running, the mean value of the two or three immediately preceding stored reference-value profiles may alternatively be used.

BRIEF DESCRIPTION OF THE DRAWING

The accompanying FIGURE schematically illustrates a diagram of the system which, according to the invention, achieves tilting of car bodies in a train set.

DESCRIPTION OF THE PREFERRED EMBODIMENTS

A number of embodiments of the invention will be described with reference to the FIGURE.

When driving through a track curve, the lateral acceleration in the leading vehicle of the train is measured, usually at its front bogie by means of at least one accelerometer 1. The resulting signal is processed in a first signal processing unit 2. Thereafter, from the measured acceleration value, the angle through which the car body of a vehicle, at full compensation for the lateral acceleration, is to tilt when the vehicle passes through the curve is calculated in a first reference-value calculator 3. The calculated angular value is multiplied in the same unit by a compensation factor which possibly may vary with the speed of the train through the curve, and a first reference-value signal is obtained. The train speed v is given by the speed transducer 12, whose signal is passed to the first reference-value calculator 3. The reference-value signal is forwarded to the computers of the subsequent vehicles together with information about a suitable delay for the respective vehicle before tilting of the car body of the respective vehicle is to be executed.

The delay for the respective vehicle is calculated in a calculator 4. The signal from the calculator 4 is passed to a regulator 5 which is provided in the respective vehicle and which, by means of a control signal, controls the hydraulic and mechanical system 6 to effect the tilting of the car body 7 in accordance with the control signal. The tilt angles of the car body 7 in relation to its two bogies, bogie A (8) and bogie B (9), respectively, is measured with a transducer at the respective bogie, whereafter the actual angular value for bogie A and bogie B, respectively, is passed to the regulator 5. The desired value for the tilt angle of the car body from the calculator 4 is compared in the regulator with the mean value of the actual values for the tilt angles of the two bogies in relation to the car body. The difference, the so-called control error, is amplified and transformed to the current signal which controls the hydraulic and mechanical system 6, as mentioned above.

Because of the increased height of the outer rail in relation to the inner rail when entering a track curve, a rail superelevation may be indicated by measuring the difference between the tilt angles of the bogies in the same vehicle. According to the FIGURE, measured angles of the tilting of the respective bogie, and the speed of the train, are passed to a second calculator 10 which generates a signal with a superelevation contribution. This signal, with the superelevation contribution, may be used for accelerating the formation of a reference value for the car body tilting. By adding this signal, the superelevation contribution, to a summator 11, the reference value calculation may be accelerated. As an alternative, a gyro may be used for the same purpose, to measure the angular velocity in the rail superelevation ramp.

The embodiment of the car body tilt function which has been described so far is part of the prior art. When using the reference-value calculation according to this method, a first reference-value signal is obtained with a delay $\tau$ than zero, as marked in the FIGURE.

According to the invention, the car body tilt system is supplemented by a second reference-value calculator 21. The second reference-value calculator 21 may be integrated with the train computer C, which comprises a memory M. A position sensor 13 registers the position n of the train at predetermined points along the route over which the train is running. The predetermined points constitute starting points for mutually unique track sections of the route. When the train is running along a given route, detection of a new starting-point for a new track section initiates storage into the memory M of a reference-value profile for the new track section in a database, in which reference-value profiles for all track sections along the route are stored. The reference-value profile consists of sampled values of a signal which is dependent on the curvature $\rho$ of curves occurring within a track section, and of a signal which is dependent on the rail superelevation angle $\phi$ of these curves.

The curvature of a curve is measured with a first gyro 14 (rate gyro yaw). The angular velocity ($d\psi/dt$) is measured around a vertical axis. After signal processing in a second signal processing unit 16, information about the angular velocity ($d\psi/dt$) for the movement around the vertical axis is passed to a calculating unit 18 in the computer C. In a corresponding way, the rail superelevation angle $\phi$ is measured with a second gyro 15 (rate gyro roll) which detects rotation by measurement of the angular velocity ($d\phi/dt$) around a longitudinal axis (the longitudinal axis for the bogie where the gyro is located). Also, this angular velocity for the movement around the longitudinal axis is passed to the calculating unit 18, to which calculating unit 18 also there are fed the signals indicating the train speed v and the detected train position n. With the aid of the current train speed v, the starting-point n of a train section, a clock pulse signal in the computer C, and the angular velocities $d\psi/dt$ and $d\phi/dt$, there are calculated in the calculating unit 18 sampled values in real time for curvature and rail superelevation angle according to functions (1) and (2) above for a track section through which the train is temporarily running. Each such sampled value is stored in a measured data memory 19, which will contain the latest version of curve-geometry data, that is, reference-value profiles, for all the track sections along the current route, when the train has covered the entire route. In connection therewith, compensation is made for the approximately known time delay. When the reference-value profiles of a whole route, here referred to as the "route contour", have been stored into the measured data memory 19, these data may be dumped to a database 20 in the memory M, which stores at least the latest dumped route contour and preferably a series of the latest stored route contours.

The reference-value profile of each track section consists of a sequence of discrete measured values. For calculation in the second reference-value calculator 21 of a lateral acceleration, based on the course of the curvature of the curve and the course of the rail superelevation from reference-value profiles in the database 20 and by means of the train speed v, which is fed to the second reference-value calculator 21, formula (3) above is utilized.

In the second reference-value calculator 21 there may also be read, from the memory M (database 20), reference-value profiles from the immediately preceding (consecutive) route contours with curve-geometry data for the track section on which the train is currently running. In this connection, data from the latest route contour, or the mean value of data from the latest consecutive route contours from the database 20, are used to form a reference value without delay ($\tau=0$), which reference value is sent to an OR circuit 22 placed in the train computer C before the calculator 4 for calculating the delay of the car body tilt in the various vehicles of the train. This makes it possible to select in the car body tilt system determination of the car body tilt either with a reference value without delay ($\tau=0$) or with delay ($\tau\neq0$), since also the instantaneous, i.e., the first, reference-value signal measured in conventional manner is passed via the OR circuit 22 to the regulator 5 of the car body tilt system.

The first reference-value signal may be selected by the OR circuit 22, for example if no track-geometry data for the current route are stored in the train database, or if the train personnel for some other reason have chosen to use the first reference-value formation.

As mentioned previously, the position sensor 13 receives information about the train position either via position transducers which are disposed along the route and which are read by equipment on board the train, or via at least one receiver installed in the train for, for example, satellite navigation according to the so-called GPS system.

The starting-point of a curve may also be stored with a known position according to the GPS system into the train computer, whereby the train computer, via the GPS receiver, continuously seeks the starting position of the next track section. When the expected position is attained, the train computer initiates storage and reading of the reference-value profile of the attained (identified) track section. In this connection may be mentioned that the reliability i.e. (accuracy) of such a positioning system increases with the use of increasingly more satellites and to a still higher extent when the navigation signals are supplemented with transmission from ground-based FM radio stations.

The hardware for calculating reference-value profiles consists of conventional electronic units.

We claim:

1. A method for tilting of a car body of a vehicle in a trackbound train when the train traverses a curved track, the respective vehicle comprising bogies supporting a car body, means for tilting the car body in relation to the bogies, means for indicating a track curve, and a control system for controlling the tilting of the car body in dependence on the geometry of the track curve, the method comprising the steps of:

determining the position of the train along a track route, point-by-point, by means for detecting its position provided on the train.

registering the curve geometry data of the track when the train traverses a track section from the determined position by means of members for determining the curve geometry and storing the registered data in real time as a sequence of measured values describing the curve geometry of said track section in an electronic memory, and using at least the latest sequence of curve-geometry measured values for the track section, stored in memory, for controlling the tilting of the car body during the next passage of the train, in the same direction, through curves within the track section.

2. A method according to claim 1, further comprising storing in the memory consecutive sequences of measured values registering curve geometry data from the consecutive running of the train in the same direction over the same track section and using a mean value of the curve-geometry data of the track section from at least two last stored consecutive sequences of measured values for controlling the tilting of the car body during passage through curves within the track section.

3. A method according to claim 1, further comprising using a sequence of measured values of curve-geometry data for a track section from the preceding running of the train in the same direction over said track section for controlling the tilting of the car body during passage through curves within the track section.

4. A method according to claim 1 wherein the position of the train along the route is determined point-by-point, by devices located on the train for reading position transducers placed along the route.

5. A method according to claim 1, wherein the position of the train is determined by the devices on the train utilizing satellite navigation.

6. Means for controlling tilting of at least one car body of a vehicle in a trackbound train when the train transverses a track curve, each respective vehicle in the train comprising bogies and a car body resting thereon, means for tilting the car body in relation to the bogies, means for indicating a track curve, and a control system for controlling the tilting of the car body in dependence on the geometry of the track curve, wherein the train is equipped with means for determining, point-by-point, the position of the train along a route, train borne devices for determining the curve geometry of the track section from a determined position by detecting a sequence of sampled measured values in real time of curve-geometry data for the track section when the train runs over said track section, an electronic memory for storing said sampled sequence of measured values of the curve geometry of the track section, and a second reference-value calculator responsive to at least the latest sequence of the curve-geometry measured values of the track section stored in the memory for calculating a reference value for the tilting of the car body in a vehicle in the train during the next passage of the train, in the same direction, through the curves within the track section.

7. The controlling means according to claim 6, wherein said devices for determining the curve geometry includes means for detecting the curvature of track curve and means for detecting the rail superelevation angle of the track curve.

8. A device according to claim 7, wherein the curvature of a track curve is detected by means of a gyro.

9. A device according to claim 7, wherein the rail superelevation angle of a track curve is detected by means of a gyro.

10. A device according to claim 6 wherein the train position determining means include a position sensor located on the train for reading a position transducer located along the route.

11. A device according to claim 6, wherein the train position determining means includes a position sensor comprising a receiver for satellite navigation, and the position of the train is read at predetermined points.

12. A device according to claim 6, wherein the train position determining means includes a position sensor comprising a receiver for satellite navigation and the position of the train is read at predetermined intervals.

13. A method for controlling a car body of a vehicle in a trackbound train passing through a track curve and wherein each respective vehicle in the train comprises bogies supporting a car body thereon, said method comprising the steps of:

a) determining the position of the train along a route, point by point, by position detecting means provided on the train;

b) registering the curve geometry of the track data when the train runs over a track section from the determined position;

c) storing in an electronic memory the curve geometry data in real time as a sequence of measured values describing the curve geometry of said track section; and d) controlling the tilting of the car body during the next passage through curves within said track section by using the previously stored curve geometry data of said track section.

* * * * *